US006836058B2

(12) United States Patent
Versluijs et al.

(10) Patent No.: US 6,836,058 B2
(45) Date of Patent: Dec. 28, 2004

(54) LOW-PRESSURE GAS DISCHARGE LAMP HAVING METALLIZATION SURROUNDED BY A RESILIENT CLAMPING ELEMENT

(75) Inventors: Cornelis Versluijs, Eindhoven (NL); Nicolass Johannes De Jong, Eindhoven (NL)

(73) Assignee: Koninklijke Philips Electronics N.V., Eindhoven (NL)

( * ) Notice: Subject to any disclaimer, the term of this patent is extended or adjusted under 35 U.S.C. 154(b) by 0 days.

(21) Appl. No.: 10/208,671

(22) Filed: Jul. 30, 2002

(65) Prior Publication Data

US 2003/0025433 A1 Feb. 6, 2003

(30) Foreign Application Priority Data

Aug. 2, 2001 (EP) ..... 01202940

(51) Int. Cl.[7] ..... H01J 5/48; H01J 5/50

(52) U.S. Cl. ..... 313/50; 313/49; 313/318.1; 313/234; 313/607

(58) Field of Search ..... 313/49, 50, 234, 313/607, 318.1, 318.05

(56) References Cited

U.S. PATENT DOCUMENTS

| | | | | | |
|---|---|---|---|---|---|
| 1,878,229 | A | * | 9/1932 | Beck | 439/230 |
| 2,624,858 | A | | 1/1953 | Greenlee | 313/201 |
| 3,156,841 | A | | 11/1964 | Ayres | 313/49 |
| 5,013,966 | A | * | 5/1991 | Saikatsu et al. | 313/493 |
| 5,082,452 | A | | 1/1992 | Takano | 439/206 |
| 5,354,208 | A | | 10/1994 | Salaski et al. | 439/230 |
| 5,387,837 | A | * | 2/1995 | Roelevink et al. | 313/484 |
| 5,432,690 | A | * | 7/1995 | Van der Vliet et al. | 362/217 |
| 5,675,214 | A | * | 10/1997 | Geven et al. | 313/491 |
| 6,094,015 | A | | 7/2000 | Wessels et al. | 315/291 |
| 6,222,647 | B1 | * | 4/2001 | Tadenuma et al. | 358/475 |
| 6,380,679 | B1 | * | 4/2002 | Leers et al. | 313/594 |
| 2002/0021564 | A1 | | 2/2002 | Cho et al. | 362/97 |
| 2003/0025452 | A1 | * | 2/2003 | Versluijs | 313/607 |

FOREIGN PATENT DOCUMENTS

| | | | | |
|---|---|---|---|---|
| EP | 240592 | A1 | * 10/1987 | H05B/41/16 |

* cited by examiner

*Primary Examiner*—Joseph Williams
*Assistant Examiner*—Maricelil Santiago

(57) ABSTRACT

A low pressure gas discharge lamp with a tubular discharge vessel is provided with two separate capacitive coupling members at its ends, the discharge vessel having a small inner diameter of preferably less than 5 mm. Each coupling member has a cylindrical tube of dielectric material. The electrical connection to the coupling members is realized by pressing a spring element having an inner diameter smaller than the outer diameter of the cylindrical tube around this tube. The spring element tightly surrounds a metal body on the cylindrical tube while forming a number of contact points.

20 Claims, 1 Drawing Sheet

PRIOR ART

Figure 1:
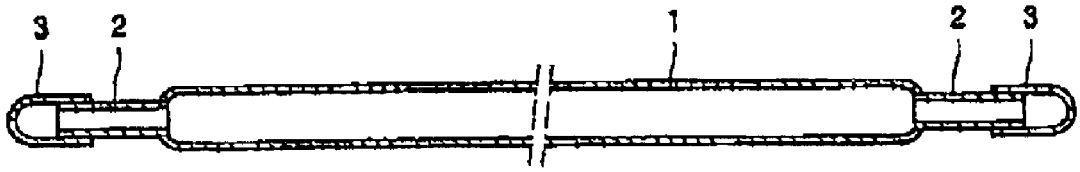

LOW-PRESSURE GAS DISCHARGE LAMP HAVING METALLIZATION SURROUNDED BY A RESILIENT CLAMPING ELEMENT

The invention relates to a low-pressure gas discharge lamp comprising a discharge vessel and at least two capacitive coupling structures which are spatially separated from one another, said discharge vessel having a small diameter of preferably 5 mm or less, while each coupling structure is formed by at least a cylindrical tube of dielectric material whose outer surface is provided with a metallization. Known gas discharge lamps consist of a vessel with a filling gas in which the gas discharge takes place, usually with two metal electrodes fixedly sealed in the discharge vessel. A first electrode supplies the electrons for the discharge, and the electrons are removed to the external current circuit again through the second electrode. The supply of the electrons usually takes place by means of glow emission (hot electrodes), but it may alternatively be generated through emission in a strong electric field or directly through ion bombardment (ion-induced secondary emission) (cold electrodes).

In an inductive mode of operation, the charge carriers are directly generated in the gas volume by an electromagnetic AC field of high frequency (typically higher than 1 MHz in the case of low-pressure gas discharge lamps). The electrons move along closed trajectories within the discharge vessel, and conventional electrodes are absent in this mode of operation. Capacitive coupling structures are used as the electrodes in a capacitive mode of operation. These capacitive electrodes are usually formed from insulators (dielectrics) which are in contact at one side for the gas discharge and which are connected to an external current circuit with electrical conduction (for example by means of a metallic contact) at the other side. An AC electric field is formed when an AC voltage is applied to the capacitive electrodes, and the charge carriers move along the relevant linear electric fields. In the high-frequency range (f>10 MHz), capacitive lamps resemble inductive lamps because the charge carriers are generated throughout the entire gas volume also in the former case. The surface properties of the dielectric electrodes are of minor importance here (so-called $\alpha$-discharge mode). At lower frequencies, the capacitive lamps change their mode of operation, and the electrons important for the discharge must be emitted originally at the surface of the dielectric electrode and must be multiplied in a so-called cathode drop region so as to keep the discharge going. The emission behavior of the dielectric material, therefore, is a determining factor for the lamp function (the so-called $\gamma$-discharge mode).

It is advantageous in a number of applications to have available fluorescent lamps of small diameter (preferably 5 mm or less) and as great as possible a quantity of light per unit lamp length (lumens per cm). Furthermore, most areas of application require a high switching stability of the lamp. This is true in particular, for example, in the case of a background illumination for a liquid crystal display. Hot-cathode lamps do not fulfill the above conditions, on the one hand for constructional reasons, and on the other hand because a small diameter of this type of lamps leads to an intensified blackening of the inner surface of the discharge vessel, which in its turn reduces lamp life.

Until recently, fluorescent lamps of small lamp diameter (5 mm or less) were found to be possible only in the form of cold-cathode lamps or in the form of capacitive gas discharge lamps with an operational frequency above 1 MHz. Cold-cathode lamps can be operated at low frequencies (30 to 50 Hz) and accordingly show only a small electromagnetic radiation. The discharge current in this type of lamp, however, is strongly limited (to a maximum of approximately 10 mA). This is caused on the one hand by a strongly intensified sputtering of the electrode material in the case of higher discharge currents. On the other hand, current limitation is necessary for preventing the electrode being heated locally so strongly that thermal emission occurs, which also leads to a strongly intensified cathode sputtering. The electrode material removed through dissolution will deposit itself in the discharge vessel, which leads to a fast blackening of the lamp.

In a capacitive discharge lamp with an operating frequency f>1 MHz, the high operating frequency in combination with a high current density in the lamp (strong current, small lamp diameter) leads to a strong electromagnetic radiation. Large-scale measures have to be taken in order to limit this electromagnetic radiation. Since the power is capacitively coupled, the operating frequency is limited in downward direction (to approximately 1 MHz) by the capacitance of the coupling surface.

EP-A-1 043 757 describes a gas discharge lamp with a capacitive coupling structure. The object here is to supply the gas discharge lamp with the capacitive coupling structure from the public mains for private domestic use without a circuit with starter electronics. This can be achieved, according to this publication, through a suitable choice of dielectric saturation polarization and an effective surface area of the dielectric. This publication does not relate to a gas discharge lamp with a diameter of preferably 5 mm or less and with an accompanying high light output.

Investigations have shown that, as regards the dielectric, a certain ratio between the thickness of the dielectric and the product of the dielectric constant and the frequency can be of importance for obtaining a low-pressure gas discharge lamp with a high light output and with a small diameter, preferably smaller than 5 mm. The gas discharge lamp may suitably be composed of a transparent discharge vessel with a usual filling gas, and may be operated with a frequency f of an AC supply source. The material of the discharge vessel and the filling gas may be chosen so as to correspond to the desired spectrum of the generated radiation. In particular, the discharge vessel may be provided with a fluorescent layer, so that the lamp emits radiation in a certain frequency range (for example in the UV range). At least two mutually separated capacitive coupling structures are present. The dielectric may be composed of one or several layers. The lamp is suitable for operating with a discharge current greater than 10 mA, in which case only a small electromagnetic radiation will occur. The fields of application of such a gas discharge lamp are wide. An important application is, for example, the use as a background illumination of a liquid crystal display.

The invention relates to the latter type of gas discharge lamps. To achieve a practical applicability, however, further electrical, mechanical, and thermal problems are to be solved. The capacitive coupling structure formed by a cylindrical tube of dielectric material in the gas discharge lamp described in EP-A-1 043 757 is provided with a metallization, for example an electrically conducting silver paste. An electrical conductor is soldered to this layer for connection to an external current source. Such an electrical contacting, however, is problematic and not suitable for mass manufacture.

A first object of the invention is to provide a solution to this problem. According to the invention, this is achieved in that the electrical connection to each coupling structure is formed by a resilient clamping element with an internal diameter smaller than the external diameter of the cylindrical tube of dielectric material, which resilient clamping element consists of a temperature-resistant material which can be easily soldered and/or welded and which resilient clamping element surrounds at least a portion of the metallization of the cylindrical tube of dielectric material with clamping force so as to form a large number of contact points, while an end portion of the resilient clamping element facing away from the discharge vessel is fastened to an electrically conducting wire by means of welding or soldering.

Such a contacting is mechanically and electrically reliable and is suitable for mass manufacture. The resilient clamping element surrounding the dielectric coupling structure may be constructed in various ways. A possible construction is, for example, a clamping helical spring which is provided with contact around the metallization of the cylindrical dielectric tube and to which an electrical conductor is soldered.

In a preferred embodiment of the invention, the resilient clamping element is formed by a resilient closing clip surrounding the coupling structure with ribs extending in longitudinal direction of the coupling structure, two ends of the closing clip being interconnected by a clamping piece provided with a slot, while the electrically conducting wire is fastened to said clamping piece.

Not only does this construction lead to a highly reliable electrical contacting and is it highly suitable for mass manufacture, but the further advantage is obtained that the ribs of the closing clip guarantee a favorable heat removal, which benefits a long lamp life.

The resilient closing clip may be made, for example, from copper, brass, or spring steel. The clamping piece provided with a slot may preferably be formed from copper or brass, to which the electrical conductor can be readily fastened.

The low-pressure gas discharge lamp according to the invention is highly suitable for being accommodated in a housing which forms a reflector. The lamp is then highly suitable for use as a background illumination for a liquid crystal display.

Favorably, the reflector may then be formed as an elongate channel of aluminum, the end portions of the lamp comprising the coupling structures and the closing clips being encapsulated in a heat-conducting but electrically insulating synthetic resin inside the end portions of the reflector.

A particularly good heat removal is obtained with a synthetic resin consisting of polyurethane filled with 50% aluminum trihydrate.

Figure 2:
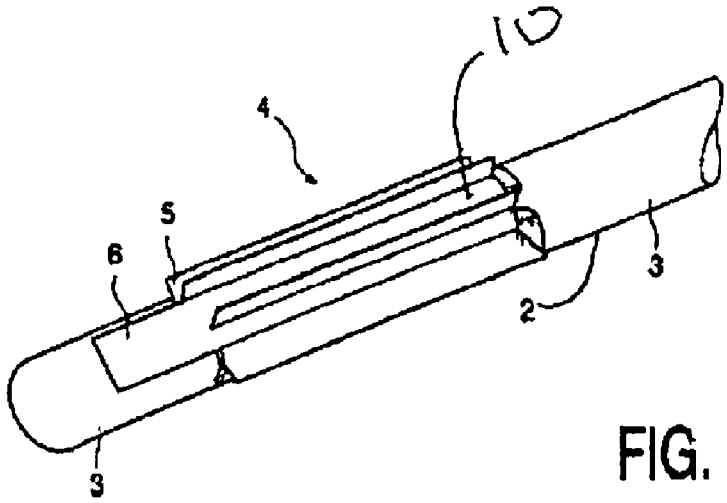
Figure 3:
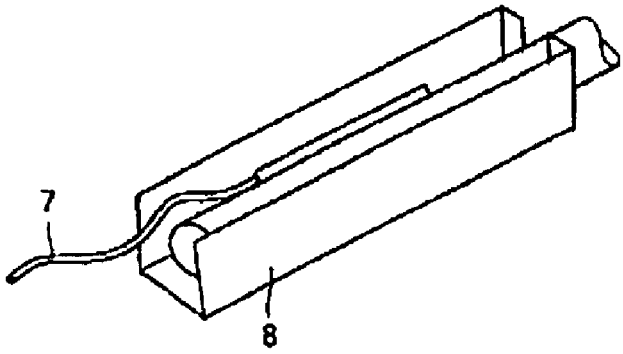
Figure 4:
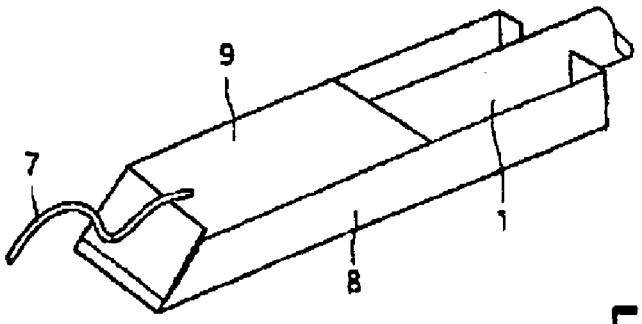

The invention will now be explained in more detail below with reference to an embodiment which is given by way of example only. In the drawing:

FIG. 1 shows a low-pressure gas discharge lamp with a capacitive coupling structure as known in the art, FIG. 2 shows an end portion of the lamp of FIG. 1, with an electrical connection in the form of a clamping closing clip in accordance with the present invention, FIG. 3 shows the gas discharge lamp provided with the clamping closing clip placed in a reflector in accordance with the present invention, and FIG. 4 shows the end portion of the lamp encapsulated in synthetic resin inside the reflector in accordance with the present invention.

In FIG. 1, a capacitive gas discharge lamp is depicted (by way of example, to which the invention is not limited), which is yet to be provided with the measures according to the invention. A glass tube 1 serves as the discharge vessel and may be provided with a phosphor layer, such that the lamp can emit radiation in the UV range. The glass tube 1 has an internal diameter of 3 mm, an external diameter of 4 mm, a length of 40 mm, and may be filled with 50 mbar Ar and 5 mg Hg. A capacitive coupling structure is formed at either end by a cylindrical tube 2 of dielectric material (a ceramic oxide such as, for example, $BaTiO_3$, $SrTiO_3$, or $PbZrO_3$). The dielectric cylinder 2 has an external diameter of just below 3 mm, a wall thickness of 0.5 mm, and a length of 14 mm. The dielectric cylinder 2 is connected to the glass tube 1 at one side by means of a glass fusion process, and is closed in a vacuumtight manner at the other side with a glass seal 3. An electrically conducting layer, for example silver paste, is provided on the dielectric cylinder, and a contact may be connected thereto. The lamp is connected to an external current supply by means of said contact. The external current supply in this embodiment may be formed by a lamp driver circuit which supplies a current of 30 mA at 40 kHz and average voltage of approximately 350 V. The lamp then generates a luminous flux of approximately 600 lumens during stationary operation. The driver unit further comprises an element for igniting the lamp. A stationary gas discharge is formed after the ignition.

A gas discharge lamp as shown in FIG. 1 is to be provided with electrical connection means. Preferably, attention should also be paid to the heat removal. The economic viability of the lamp requires that the electrical connection and the heat removal should be suitable for mass manufacture.

FIG. 2 shows an end portion of the gas discharge lamp provided with connection means which are preferably used. Central to the invention is that a resilient clamping element provided around the metallization surrounding the cylindrical tube 2 is used for the electrical connection. This resilient element may have various constructions, for example that of a helical spring. In the preferred embodiment shown in FIG. 2, the resilient element is formed as a closing clip 4 which surrounds the coupling structure 2 with clamping force. This closing clip has ribs 5 which extend in longitudinal direction of the cylindrical tube 2. The resilient closing clip 4 is fastened with clamping force around the coupling structure 2 by means of a clamping piece 6. The clamping piece is formed by a metal strip provided with a slot 10 (of which a widening end is visible in FIG. 2). The resilient closing clip 4 is bent around the cylindrical tube 2, and the slot of the clamping piece 6 is passed over the two ends of the clip so as to fasten the clip. The clip has dimensions such that the internal diameter (the innermost ends of the ribs 5) is smaller than the external diameter of the tube 2 after fastening by means of the clamping piece 6, so that a large number of contact points with the metallization around the tube 2 are made by the ribs, which forms a highly reliable electrical connection. An electrically conducting wire 7 may now be soldered or welded to the clamping piece 6, which wire can be connected to a current source.

The material of the closing clip 4 will preferably be copper, brass, or spring steel. The clamping piece 6 is preferably formed from copper or brass, because the electrically conducting wire 7 can be readily soldered thereto. The shape of the resilient closing clip not only provides a reliable contacting of the lamp in mass manufacture, but the ribs 5 also provide a large surface area in a comparatively small space, which benefits the heat removal.

FIG. 3 shows an end portion of a reflector in which the lamp can be accommodated. The reflector 8 preferably consists of a channel-shaped aluminum part. On the one hand, aluminum has a strong reflecting power, while on the other hand it contributes strongly to the heat removal. To fix the lamp in the channel 8, the glass tube 1 is surrounded by a disc (not shown) adjacent each end adjoining the coupling structure 2, the outer circumference of said disc fitting the inner wall of the channel 7. The ends of the channel 7 may be closed off each by a disc (not shown).

A thermally conducting, electrically insulating synthetic resin 9 is provided in the space between the discs situated at each end of the channel, as shown in FIG. 4. The lamp is fastened in the reflector thereby, while the synthetic resin also contributes to a further heat removal.

The synthetic resin is preferably formed by polyurethane. To improve the heat removal, the polyurethane may be filled with a thermally conducting, electrically insulating filler such as, for example, aluminum trihydrate.

While the embodiments of the invention disclosed herein are presently considered to be preferred various changes and modifications can be made without departing from the spirit and scope of the invention. The scope of the invention is indicated in the appended claims, and all changes that come within the meaning and range of equivalents are intended to be embraced therein.

What is claimed is:

1. A low-pressure gas discharge lamp, comprising;

a discharge vessel;

a first cylindrical tube of dielectric material connected to said discharge vessel;

a first metallization provided on said first cylindrical tube of dielectric material; and a first resilient clamping element including a first unitary clamping piece surrounding at least a portion of said first metallization.

2. The low-pressure gas discharge lamp of claim 1, further comprising:

a second cylindrical tube of dielectric material connected to said discharge vessel, said second cylindrical tube of dielectric material being spatially separated from said first cylindrical tube of dielectric material;

a second metallization provided on said second cylindrical tube of dielectric material; and a second resilient clamping element including a second unitary clamping piece surrounding at least a portion of said second metallization.

3. The low-pressure gas discharge lamp of claim 1, wherein an internal diameter of said discharge vessel is 5 mm or less.

4. The low-pressure gas discharge lamp of claim 1, wherein an internal diameter of said first resilient clamping element is less than an external diameter of said first cylindrical rube of dielectric material.

5. The low-pressure gas discharge lamp of claim 1, wherein said first resilient clamping element forms a plurality of contact points.

6. The low-pressure gas discharge lamp of claim 1, wherein said first resilient clamping element is fastened to an electrically conducting wire.

7. The low-pressure gas discharge lamp of claim 1, wherein said first resilient clamping element includes a resilient closing clip surrounding the at least a portion of said first metallization.

8. The low-pressure gas discharge lamp of claim 7, wherein said resilient closing clip includes at least one rib extending in a longitudinal direction of said first cylindrical tube of dielectric material.

9. The low-pressure gas discharge lamp of claim 7, wherein said unitary clamping piece is a metal strip having a slot.

10. The low-pressure gas discharge lamp of claim 9, wherein said clamping piece is fastened to an electrically conducting wire.

11. The low-pressure gas discharge lamp of claim 9, wherein said clamping piece is made of copper or brass.

12. The low-pressure gas discharge lamp of claim 7, wherein said resilient closing clip is made of copper or brass.

13. The low-pressure gas discharge lamp of claim 7, wherein said resilient closing clip is made of spring steel.

14. The low-pressure gas discharge lamp of claim 1, wherein said lamp is accommodated in a housing which forms a reflector.

15. The low-pressure gas discharge lamp of claim 14, wherein said reflector is formed as an elongated channel; and wherein said first cylindrical tube of dielectric material and said first resilient clamping element are disposed with the elongated channel.

16. The low-pressure gas discharge lamp of claim 15, wherein said first cylindrical tube of dielectric material arid said first resilient clamping clement are encapsulated within the elongated channel in a thermally conducting arid electrically insulating synthetic resin.

17. The low-pressure gas discharge lamp of claim 16, wherein said symbolic resin consists of polyurethane filled with 50% aluminum trihydrate.

18. A lighting device comprising:

a low-pressure gas discharge lamp including a discharge vessel, a cylindrical tube of dielectric material connected to said discharge vessel, a metallization provided on said cylindrical tube of dielectric material, and a resilient clamping clement surrounding at least a portion of said metallization; and a reflector forming elongated channel, wherein said cylindrical rube of dielectric material and said resilient clamping element are disposed with the elongated channel, wherein said cylindrical tube of dielectric material and said resilient clamping element are encapsulated within the elongated channel in a thermally conducting and electrically insulating synthetic resin, and wherein said synthetic resin consists of polyurethane filled with aluminum trihydrate.

19. The lighting device of claim 18, wherein said synthetic resin consists of polyurethane filled with 50% aluminum trihydrate.

20. A low-pressure gas discharge lamp, comprising:

a discharge vessel;

a cylindrical tube of dielectric material connected to said discharge vessel, a metallization provided on said cylindrical tube of dielectric material; and a resilient clamping element including a clamping piece surrounding at least a portion of said metallization, and at least one rib extending along said clamping piece in a longitudinal direction of said cylindrical rube of dielectric material.

* * * * *